US006146256A

United States Patent [19]

Joo

[11] Patent Number: 6,146,256

[45] **Date of Patent: *Nov. 14, 2000**

[54] CLAMPING WAFER HOLDER FOR CHEMICAL-MECHANICAL PLANARIZATION MACHINES AND METHOD FOR USING IT

[75] Inventor: Joon-Yong Joo, Seoul, Rep. of Korea

[73] Assignee: Samsung Electronics, Co. Ltd., Suwon, Rep. of Korea

[ * ] Notice: Under 35 U.S.C. 154(b), the term of this patent shall be extended for 00 days.

[21] Appl. No.: 09/306,234

[22] Filed: May 6, 1999

[30] Foreign Application Priority Data

May 6, 1998 [KR] Rep. of Korea ..... 98-16207

[51] Int. Cl.[7] ..... B24B 7/00

[52] U.S. Cl. ..... 451/285; 451/287; 451/398; 451/387; 451/405

[58] Field of Search ..... 451/41, 285, 287, 451/288, 388, 384, 397, 398, 405, 387, 365

[56] References Cited

U.S. PATENT DOCUMENTS 5,095,661 3/1992 Gill et al. ..... 51/131.3
5,549,502 8/1996 Tanaka et al. ..... 451/41
5,597,346 1/1997 Hempel, Jr. ..... 451/287
5,605,487 2/1997 Hileman et al. ..... 451/41
5,702,292 12/1997 Brunelli et al. ..... 451/41

*Primary Examiner*—Eileen P. Morgan
*Attorney, Agent, or Firm*—Marger Johnson & McCollom, P.C.

[57] ABSTRACT

A clamping wafer holder for chemical - mechanical planarization ("CMP") machines is provided. It comprises a plate having a surface for receiving on it the wafer, and a retainer around the surface. The retainer includes at least two jaws shaped and arranged such that they define a recess with the surface. The wafer is placed in the recess. An actuator is coupled with the retainer and adjusts it from an open position where the jaws are separated from each other, to a closed position where the jaws clamp an edge portion of the wafer. When the retainer is in the closed position the jaws preferably contact each other and define a continuous cylindrical inner surface. The surface can have a stopper that engages a flat zone of a wafer. Where the shape of the jaws does not match exactly the periphery of the wafer, elastic inserts are mounted on the jaws. A vacuum source is coupled with the plate, to hold the wafer in the holder during reorientation. The actuator is advantageously operated by the vacuum source. Since the wafer is supported stably, it does not shift laterally within the recess, which reduces uneven polishing.

11 Claims, 9 Drawing Sheets

CLAMPING WAFER HOLDER FOR CHEMICAL-MECHANICAL PLANARIZATION MACHINES AND METHOD FOR USING IT

FIELD OF THE INVENTION

The present invention generally relates to an apparatus for manufacturing electronic devices, and more particularly to a wafer holder that supports stably a semiconductor wafer during a chemical - mechanical planarization process.

BACKGROUND OF THE INVENTION

During manufacture of integrated circuit wafers, the wafer surface is sometimes treated by a chemical - mechanical planarization ("CMP") process. The treatment, also called chemical - mechanical polishing, is carried out by a so called CMP machine.

An example of a typical CMP machine is described in U.S. Pat. No. 5,702,292 to Brunelli et al. During polishing the CMP machine brings the wafer surface in contact with a rotating polishing pad under a biasing force.

Some CMP machines maintain the wafer in a wafer holder that faces up for loading the wafer on it. The wafer holder then faces down for polishing the wafer. During the reorientation the wafer is prevented from falling off by using a vacuum, as is taught in U.S. Pat. No. 5,095,661 to Gill et al.

Referring to FIGS. 1A and 1B, the wafer is preferably maintained in a recess of the wafer holder, as is also taught in U.S. Pat. No. 5,597,346 to Hempel, Jr. Specifically, a wafer holder 300 defines a recess 302 for receiving therein a wafer 304. The recess is bounded by a rim that decreases in height away from the recess.

During polishing, the biasing force enhances friction, which causes the wafer to shift laterally within the recess, in spite of the vacuum. Shifting is unavoidable, because the diameter of the recess must be larger than that of the wafer, so that the recess can receive the wafer in the first place. The diameter difference "d" determines the extent of shifting.

The lateral shifting results in uneven polishing, which limits how well the wafer can be polished. Uneven polishing results in local areas of over-polishing and under-polishing, that interfere with photolithographic etching processes for making integrated circuit structures. It also results in an uneven thickness of the planarization layer of the wafer. This does not permit a good functional die to be achieved from the wafer, and makes it difficult to maintain fine resolution tolerances in the wafer.

SUMMARY OF THE INVENTION

Accordingly, an object of the present invention is to provide a wafer holder for chemical - mechanical planarization machines that supports stably a semiconductor wafer, effectively preventing it from shifting during polishing.

In order to accomplish the above object, the present invention provides a clamping wafer holder for chemical - mechanical planarization machines. The clamping wafer holder comprises a plate having a surface for receiving on it the wafer, and a retainer around the surface. The retainer includes at least two jaws shaped and arranged such that they define a recess with the receiving surface. The wafer is to be placed in the recess.

The wafer holder also includes an actuator coupled with the retainer and adjusting it. The retainer can be adjusted from an open position where the jaws are separated from each other, to a closed position where the jaws clamp an edge portion of a wafer in the recess. When the retainer is in the closed position the jaws preferably contact each other. When they do, they define a continuous inner surface.

In the first embodiment, the inner surface is cylindrical. In the second embodiment the surface includes a stopper that engages a flat zone of a wafer. Where the shape of the jaws does not match exactly the periphery of the wafer, elastic inserts are mounted on the jaws that result in distributing the lateral clamping force more evenly.

A vacuum source is coupled with the plate, to hold the wafer in the recess during reorientation. The actuator is advantageously operated by the vacuum source. The actuator is coupled with at least one of the jaws by three pins. The actuator is preferably coupled also with the plate, in which case the pins go through elongate slots in the plate.

A method for performing chemical - mechanical polishing on a surface of a wafer according to the invention comprises the step of placing the wafer in a wafer holder such that the wafer surface is exposed. A vacuum helps maintain the wafer onto the wafer holder.

The wafer is then laterally stabilized with respect to the wafer holder. This is performed by radially clamping an edge portion of the wafer. Clamping is performed by moving jaws of a retainer of the wafer holder. Then the exposed wafer surface is positioned against a polishing surface, and polished as is known in the art.

The wafer holder of this invention results in a configuration that eliminates the diameter difference "d" of the prior art. The wafer is supported stably and prevented from shifting laterally during polishing. This effectively reduces the amount of uneven polishing, thus achieving a good wafer. In addition, when the retainer includes a stopper that engages the flat zone of the wafer, the wafer holder does not need a device for adjusting the weight balance. Thus, the wafer holder is simpler to make.

BRIEF DESCRIPTION OF THE DRAWINGS

The above object, and other features and advantages of an apparatus of the present invention will be more clearly understood from the following detailed description taken in conjunction with the accompanying drawings, which are not necessarily to scale and in which.

DESCRIPTION OF THE PREFERRED EMBODIMENT

FIGS. 2A–3C illustrate a clamping wafer holder in accordance with the first embodiment of the present invention.

Figure 1A:
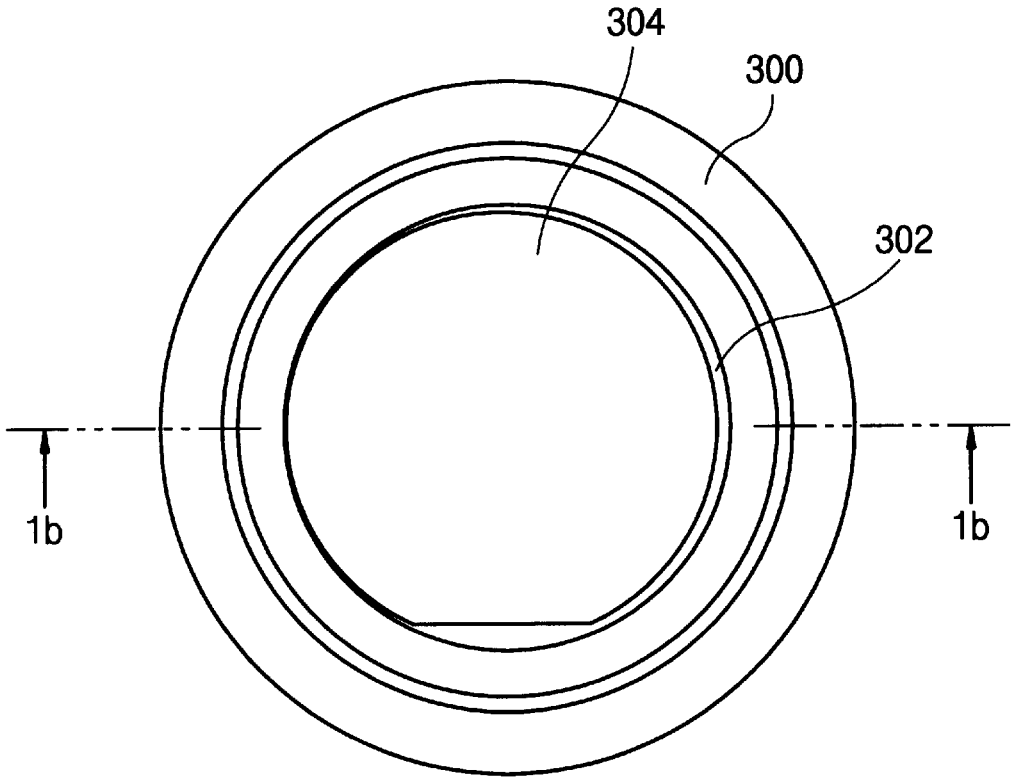
Fig. 1A (Prior Art)
FIG. 1A is a plan view of a wafer loaded in a prior art wafer holder.
Figure 1B:
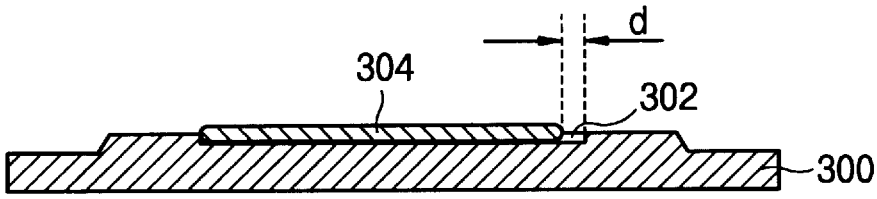
Fig. 1B (Prior Art)
FIG. 1B is a cross-sectional view taken along line 1*b*—1*b* of FIG. 1A.
Figure 2A:
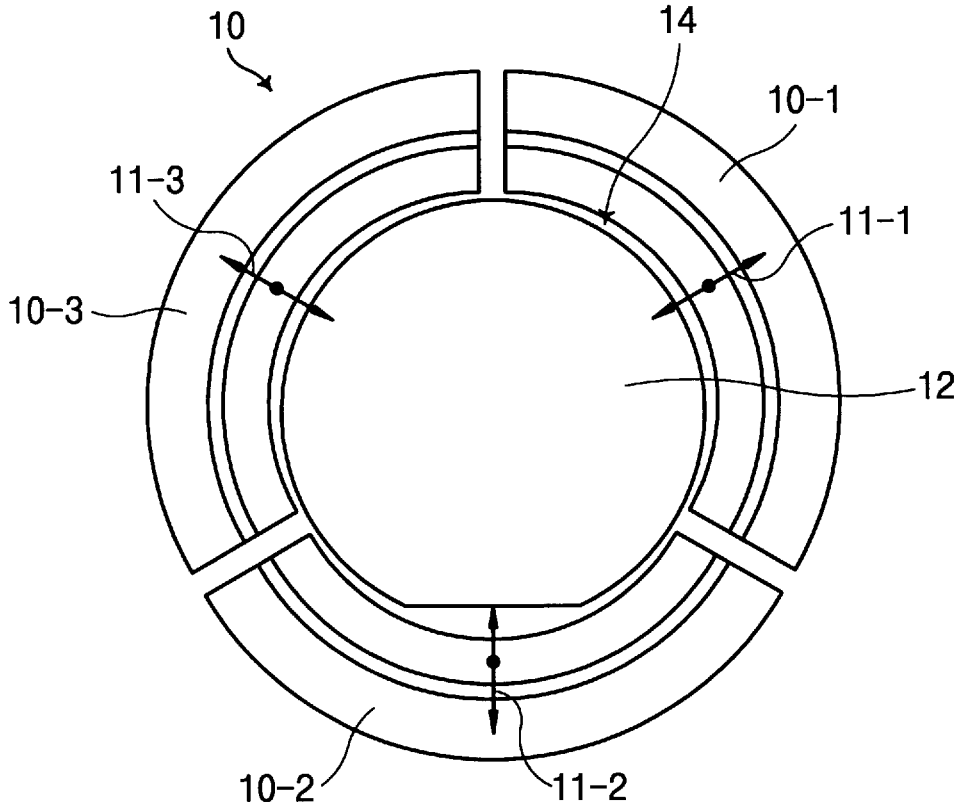
FIG. 2A is a plan view of a wafer in a retainer of a clamping wafer holder made according to the first embodiment of the present invention, that has a retainer in the open position.
Figure 2B:
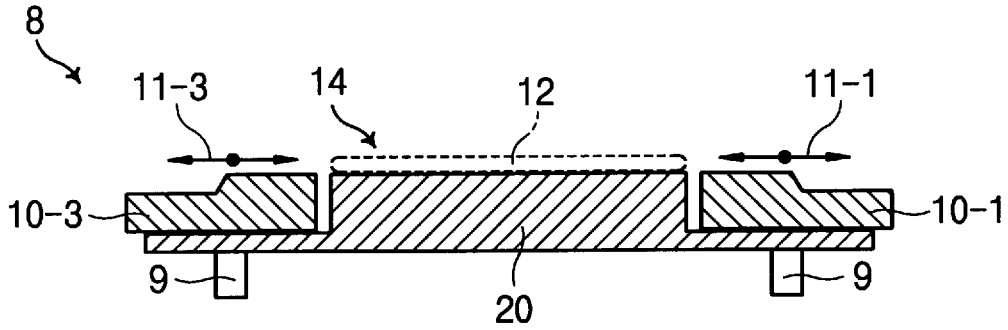
FIG. 2B is a cross sectional view of a clamping wafer holder made according to the first embodiment of the present invention in the loading orientation.

Referring to FIG. 2B, clamping wafer holder 8 has a plate 20 with a receiving surface for receiving thereon a semiconductor wafer 12. The wafer holder also includes a retainer comprised of jaws. The jaws are shaped and arranged such that they define a recess 14 with the receiving surface. Wafer 12 is thus placed in the recess. The dimensions are such that the surface of the wafer that is to be polished protrudes from the recess.

Clamping wafer holder 8 also includes at least one actuator 9. The actuator is coupled with and adjusts the retainer by moving at least one of the jaws with respect to the others. In the embodiment of FIGS. 2A–3C, retainer 10 has three jaws 10-1, 10-2 and 10-3. The jaws are moveable with respect to the plate according to arrows 11-1, 11-2 and 11-3, respectively. Alternately, at least one of the jaws can be in a fixed relationship with respect to the plate, and even a part of it.

Figure 3A:
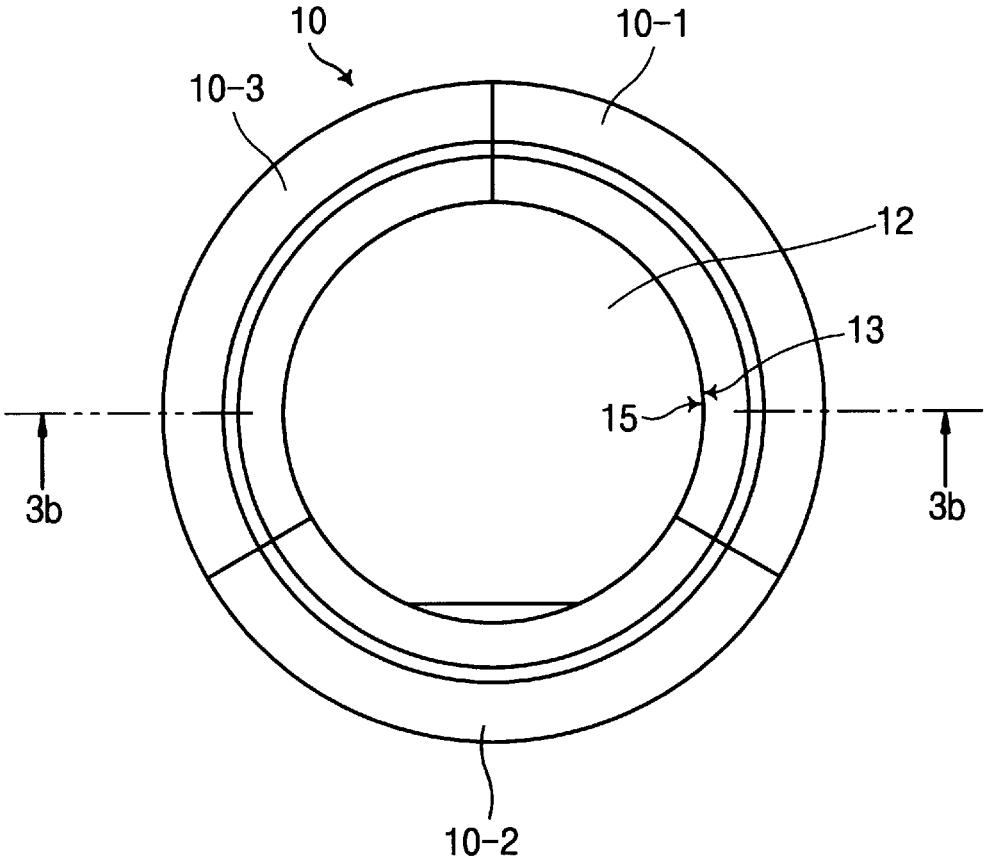
FIG. 3A is a plan view of the wafer and the retainer of the clamping wafer holder of FIG. 2A, but in the closed position.
Figure 3B:
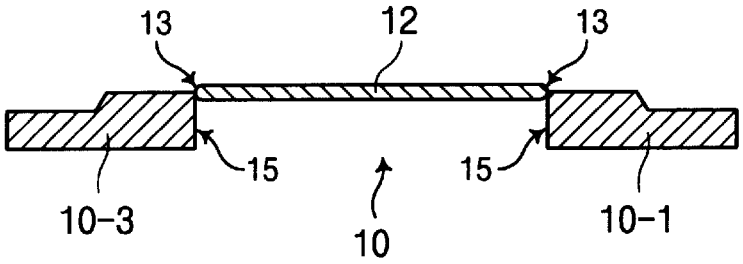
FIG. 3B is a cross-sectional view taken along line 3*b*—3*b* of FIG. 3B.

The jaw movement defines two positions for the retainer. FIGS. 2A and 2B show the open position, where the jaws are separated. FIGS. 3A and 3B show the closed position, i.e. where the jaws have clamped radially on edge portion 13 of wafer 12. Clamping stabilizes laterally the wafer with respect to the holder.

Preferably, the jaws are further arranged such that they contact each other when the retainer is in the closed position. In that case the retainer forms a continuous inner surface. In the first embodiment of the invention the inner surface is cylindrical. Preferably inner surface 15 has the same diameter as the wafer, as seen in FIG. 3A. As a result, a diameter difference is not formed between wafer 12 and retainer 10.

Figure 3C:
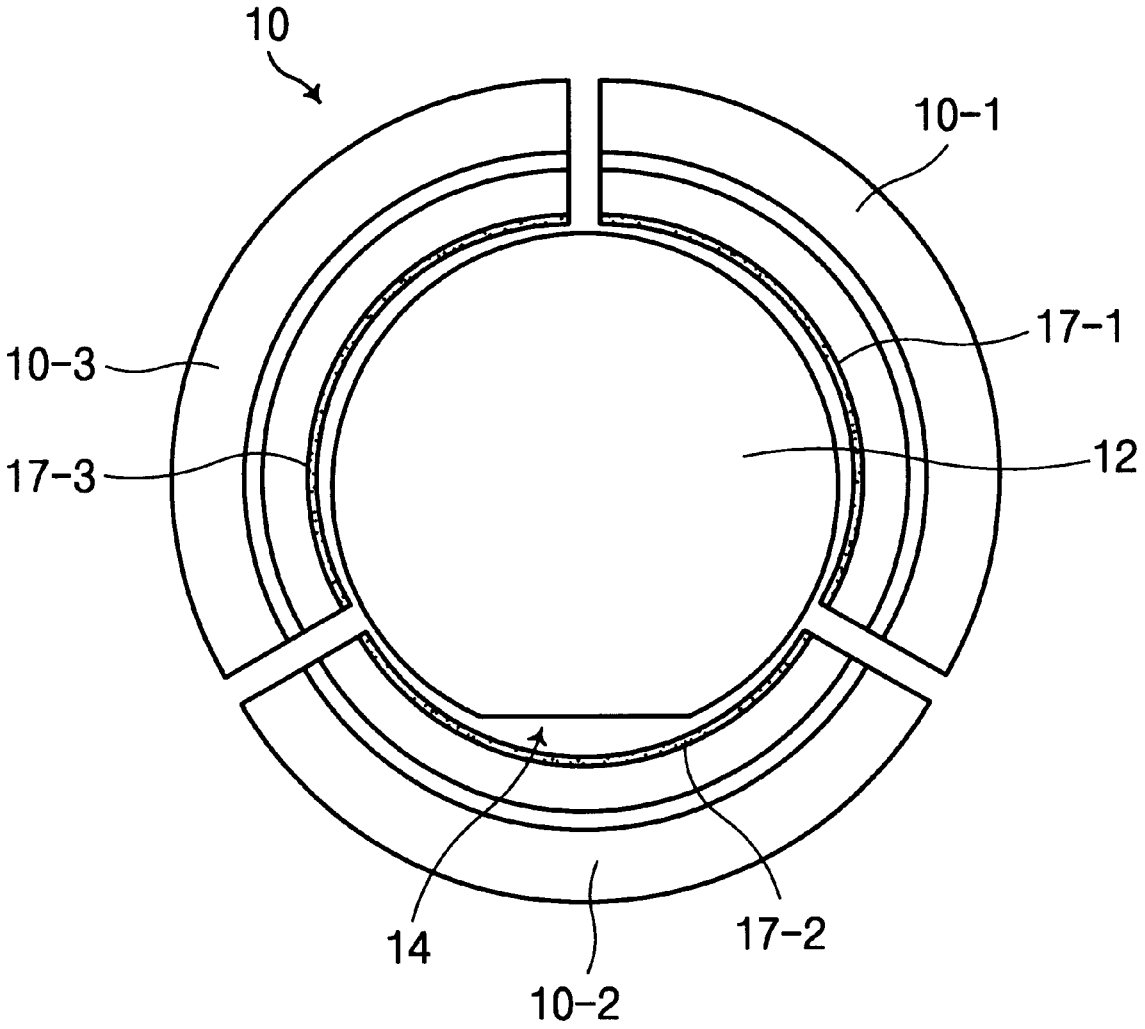
FIG. 3C is a plan view of the wafer and the retainer of the clamping wafer holder of FIG. 2A, with the retainer in the closed position and using an elastic insert.

If the shapes and/or diameters could be mismatched, elastic inserts 17-1, 17-2, 17-3 can be mounted on the jaws, as seen in FIG. 3C. The elastic inserts distribute the lateral clamping force of the jaws more evenly around the periphery of the wafer, thus not damaging it. The inserts prevent the wafer from shifting within the recess, thus reaping the benefits of the invention.

Figure 4A:
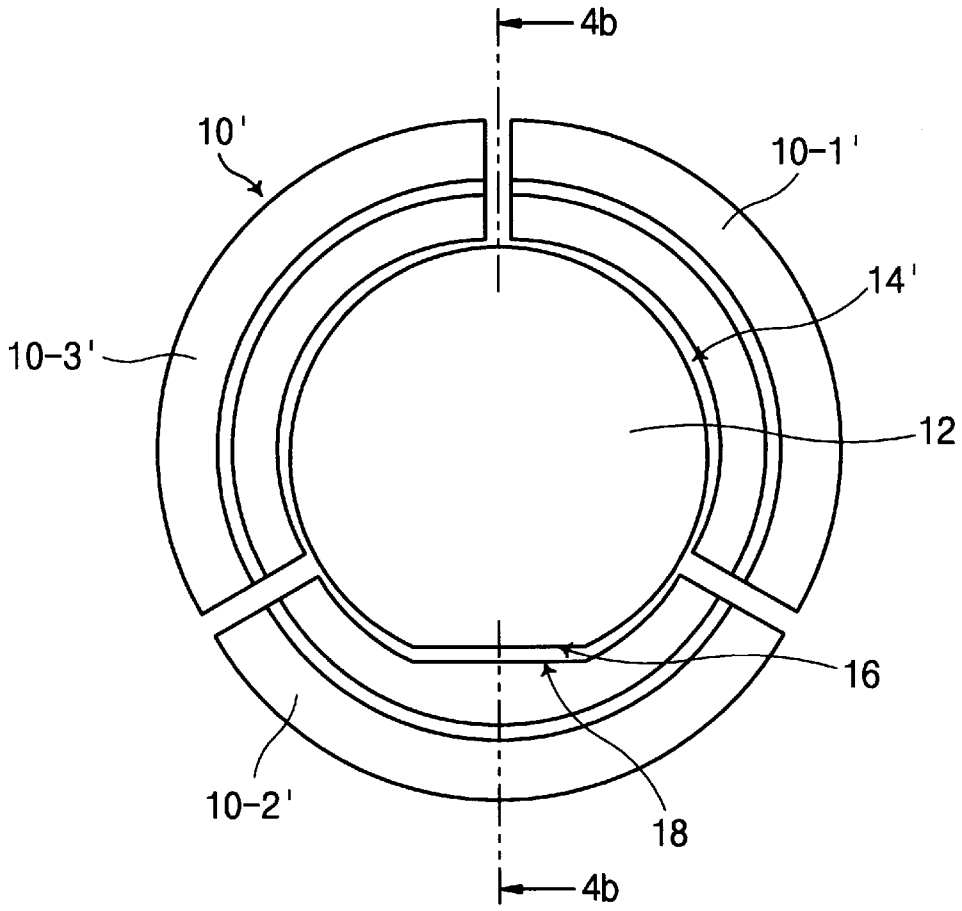
FIG. 4A is a plan view of a wafer and a retainer in the open position made according to the second embodiment of the present invention.
Figure 4B:
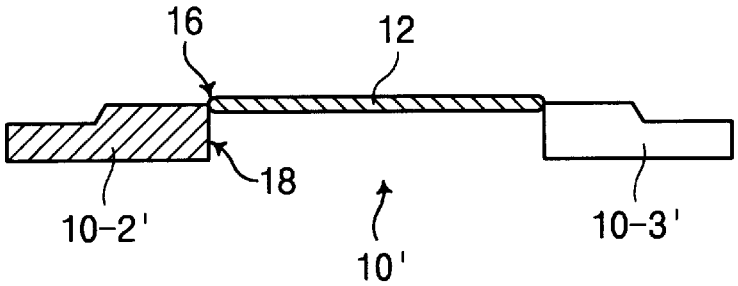
FIG. 4B is a cross-sectional view taken along line 4*b*—4*b* of FIG. 4A, but with the retainer in the closed position.

FIGS. 4A and 4B are views illustrating a retainer of a clamping wafer holder made in accordance with the second embodiment of the present invention. Components similar to those of the first embodiment are denoted by similar reference numbers, using also a prime (').

As shown in FIGS. 4A and 4B, second jaw 10-2' includes a stopper 18 that engages a flat zone 16 of wafer 12. The flat zone is used to set the level of wafer 12, when a plurality of semiconductor devices are formed on the wafer. The stopper has a shape complementary to the flat zone. During polishing, any force applied to the flat zone is transmitted through the stopper to the retainer. In addition, when the stopper is used there is no need to adjust a weight balance of the wafer holder, such as by mounting a device to it. Thus, the wafer holder is simpler to make. Of course, when it is not necessary to engage the flat zone, the first embodiment of this invention may be used.

Figure 5:
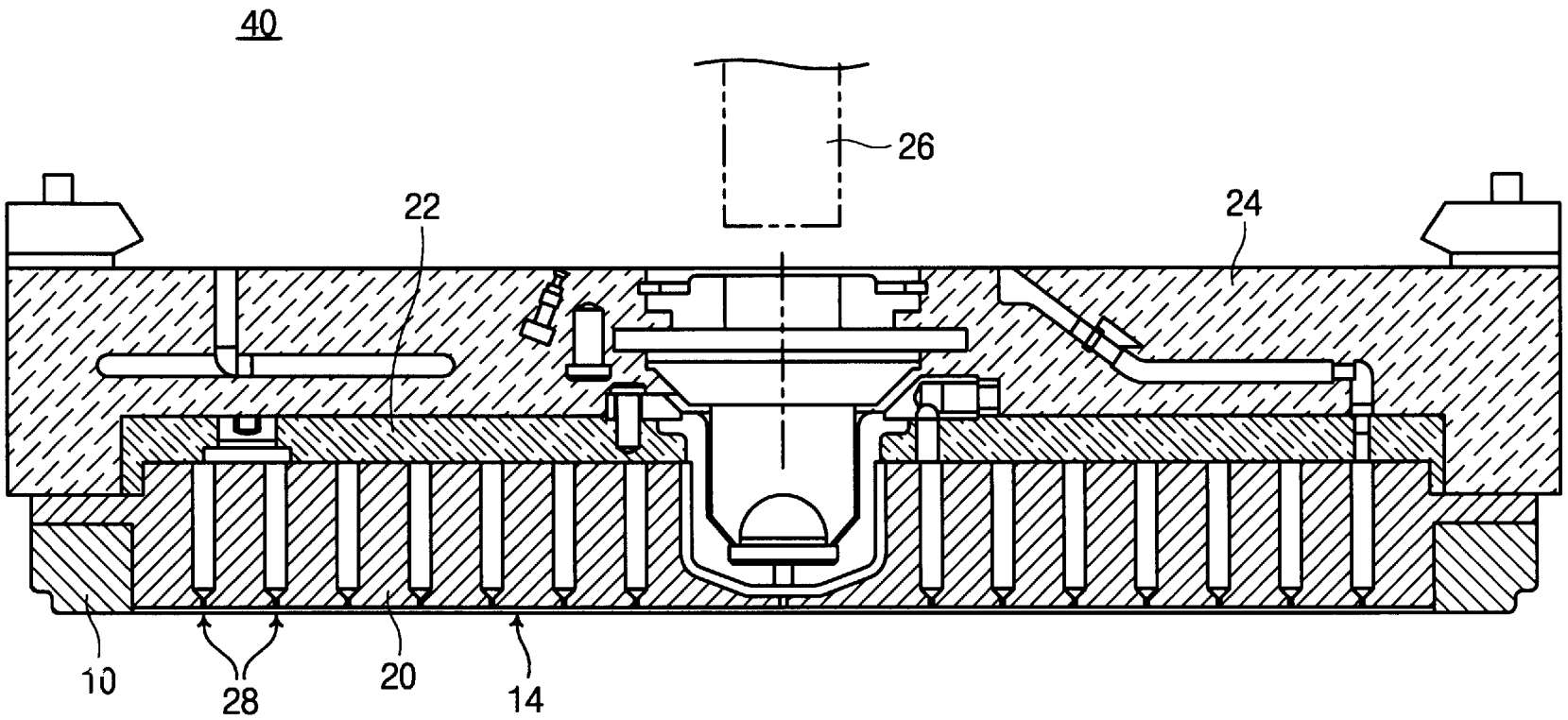
FIG. 5 is a detailed sectional view of the clamping wafer holder of FIG. 2B in the polishing orientation.

FIG. 5 is a sectional view illustrating a clamping wafer holder made according to the invention. Clamping wafer holder 40 comprises a mounting plate 20, which is also known as plate 20. The plate has a receiving surface for receiving a wafer on it. Wafer holder 40 also includes a manifold plate 22 and a top plate 24. The wafer holder further includes a plurality of parts mounted to top plate 24, for connecting it to a CMP machine. For example, top plate 24 has a configuration capable of receiving a drive shaft 26 of the CMP machine. Once the wafer is loaded onto plate 20, drive shaft 26 inverts the wafer holder to the polishing orientation of FIG. 5, as is known in the art.

A vacuum is used to prevent the wafer from falling off the plate during the reorientation, as is known in the art. For example, a plurality of holes 28 can be formed through mounting plate 20. Manifold plate 22 is configured to couple holes 28 with a vacuum source.

Clamping wafer holder 40 also has a retainer 10 that defines a recess 14 with plate 20. The retainer can be in the open or closed position as is described below in more detail.

Figure 6A:
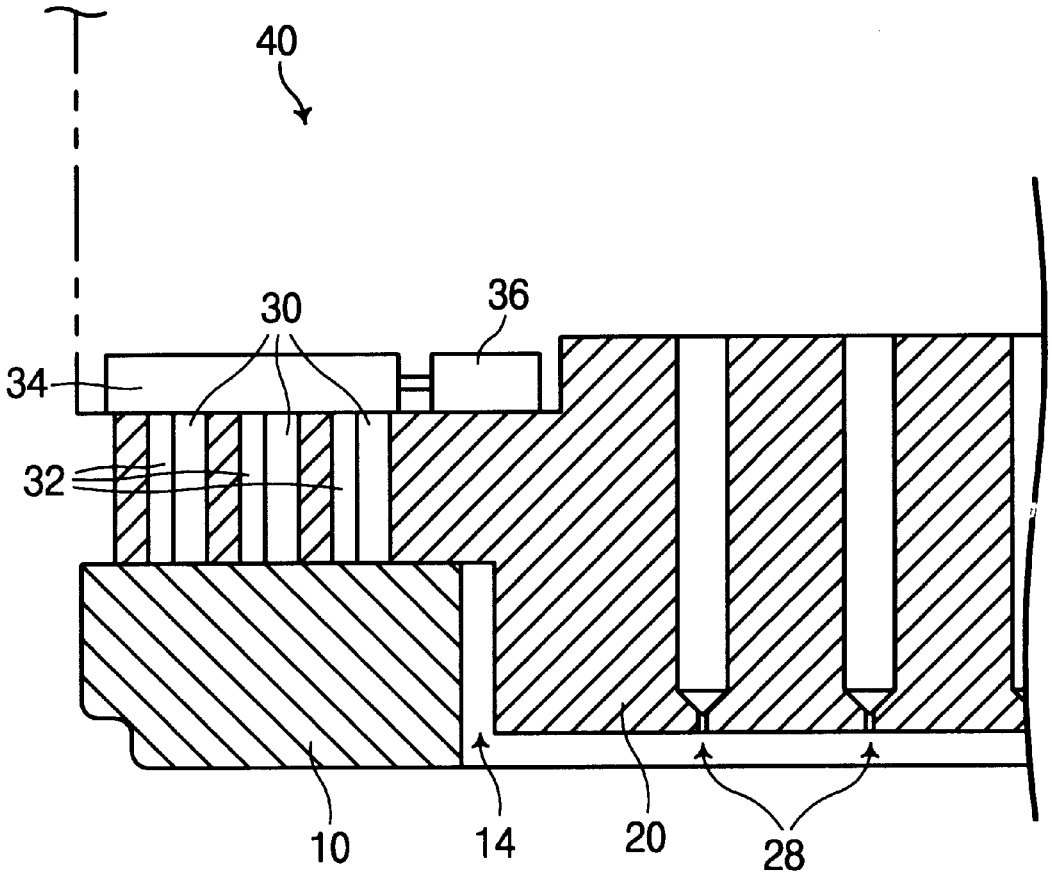
FIG. 6A is a detail of FIG. 5, with the retainer in the open position.
Figure 6B:
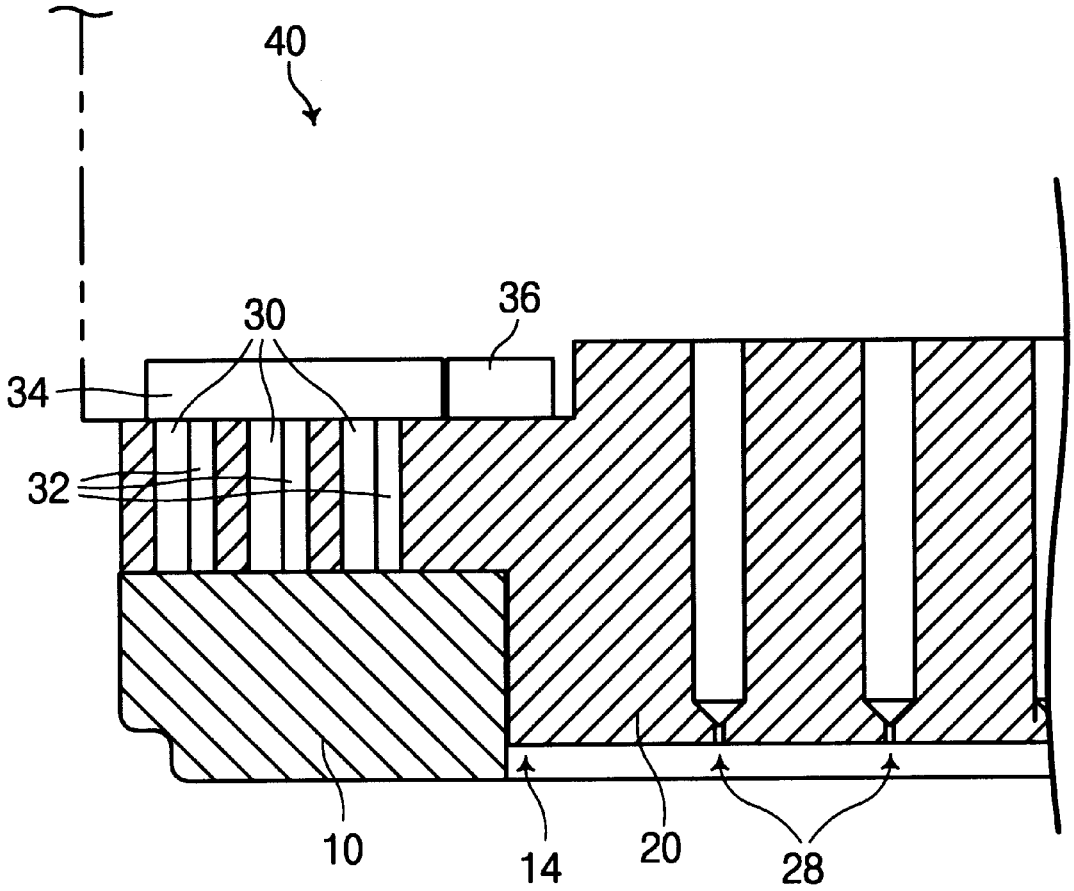
FIG. 6B is a detail of FIG. 5, with the retainer in the closed position.

Referring to FIGS. 6A and 6B, a cylinder 36 opens and closes the retainer. Cylinder 36 is an actuator that adjusts the retainer by moving the jaws. The cylinder is preferably mounted onto mounting plate 20

The actuator can be connected to an electric or hydraulic motor or pump, etc. A variety of power sources can be used. In the preferred embodiment of this invention, cylinder 36 is advantageously operated by the vacuum source already coupled with the mounting plate. In addition, cylinder 36 is controlled by a controller (not shown) that is made as is known in the art.

Preferably one cylinder 36 is used for each of the moveable jaws. Each cylinder is further connected to a rocker 34, which is connected to three pins 32 that are attached to the jaw. This connection permits stable lateral operation of the jaw. The pins go through respective elongate slots 30 formed through mounting plate 20. Slots 30, also called channels 30, have a length determined by the travel of the jaw they are attached to.

Figure 7:
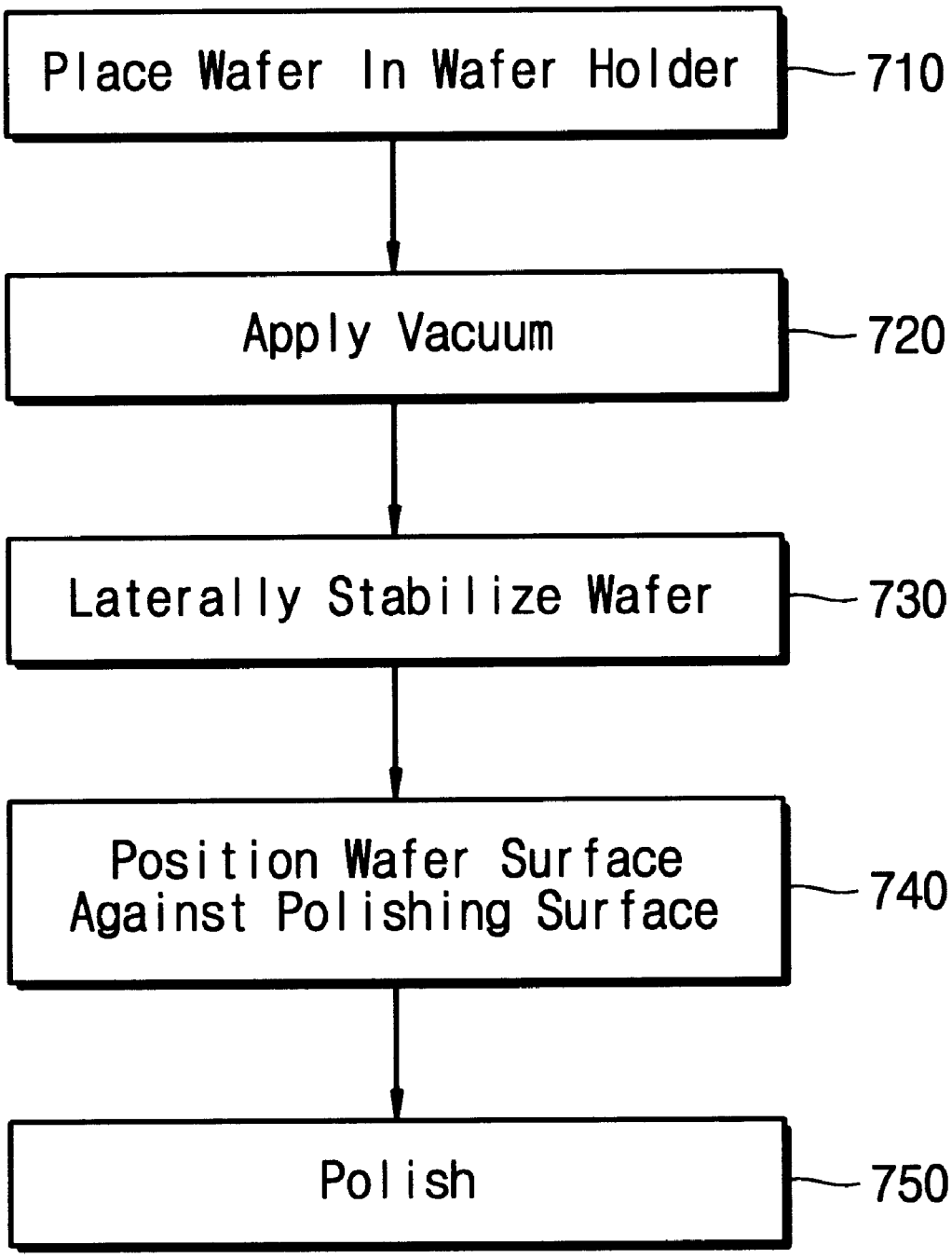
FIG. 7 is a flowchart illustrating method steps of the invention.

Referring to FIG. 7, a first method according to the present invention is described for performing chemical - mechanical polishing of a surface of a wafer. According to step 710, the wafer is placed in the wafer holder of a CMP machine, and particularly onto a receiving surface of the wafer holder. Placing is such that the wafer surface that is to be polished is exposed.

According to optional step 720, a vacuum is applied to maintain the wafer onto the receiving surface, as is known in the art. This way the wafer will not fall off if the wafer holder is reoriented.

As a next step 730, the wafer is laterally stabilized with respect to the wafer holder. This step is performed by radially clamping an edge portion of the wafer. Clamping is advantageously performed by jaws of the retainer that are made as described above.

In a subsequent step 740, the exposed wafer surface is positioned against a polishing surface. This is typically accomplished as is known in the art, and may involve reorientation of the wafer holder.

As a next step 750, the exposed wafer surface is polished by being moved laterally with respect to the exposed wafer surface under a biasing force, as is known in the art.

Still referring to FIG. 7, steps 710 and 730 result in securing a wafer onto a wafer holder of a CMP machine according to a second method of the invention. The second method optionally also comprises step 720.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A wafer holder for chemical-mechanical planarization head portion of a wafer-processing machine comprising:

a plate having a surface for receiving a wafer thereon;

a retainer including at least two jaws shaped and arranged such that they define a recess with the receiving surface; and an actuator coupled with and adjusting the retainer from an open position where the jaws are separated from each other to a closed position where the jaws clamp an edge portion of a wafer received in the recess.

2. The wafer holder of claim 1, wherein the actuator is coupled with the plate.

3. The wafer holder of claim 1, wherein the actuator is a motor.

4. The wafer holder of claim 1, further comprising a vacuum source coupled with the plate and operable to adhere the surface of a wafer to the plate during actuation of the jaws from the open position to the closed position.

5. The wafer holder of claim 4, wherein the actuator is operated by the same vacuum source as the vacuum source that is operable to adhere the surface of the wafer to the plate.

6. The wafer holder of claim 1, wherein the actuator is coupled with at least one of the jaws by at least one pin.

7. The wafer holder of claim 6, wherein the plate defines at least one channel, and wherein the pin transverses the channel as the retainer is adjusted from the open position to the closed position.

8. The wafer holder of claim 1 for supporting a wafer that includes a flat zone, wherein a jaw of the retainer includes a stopper shaped complementary to the flat zone.

9. The wafer holder of claim 1, further comprising an elastic insert mounted in the recess.

10. The wafer holder of claim 1, wherein the jaws are further arranged such that when the retainer is in the closed position the jaws contact each other.

11. The wafer holder of claim 10, wherein when the jaws contact each other they define a continuous inner surface that is cylindrical.

* * * * *